US009714119B2

(12) United States Patent
Plourde et al.

(10) Patent No.: US 9,714,119 B2
(45) Date of Patent: Jul. 25, 2017

(54) END CLIP WITH SNAP ON AND WELD INSTALLATION

(71) Applicant: ILLINOIS TOOL WORKS INC., Glenview, IL (US)

(72) Inventors: Eric Plourde, Frankfort, IL (US); Clifton Howell, Burford, GA (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 346 days.

(21) Appl. No.: 14/618,362

(22) Filed: Feb. 10, 2015

(65) Prior Publication Data

US 2015/0232234 A1 Aug. 20, 2015

Related U.S. Application Data

(60) Provisional application No. 61/940,995, filed on Feb. 18, 2014.

(51) Int. Cl.

| | |
|---|---|
| ***A44B 19/02*** | (2006.01) |
| ***B65D 33/25*** | (2006.01) |
| ***A44B 19/16*** | (2006.01) |
| ***A44B 19/24*** | (2006.01) |

(52) U.S. Cl.

CPC ..... *B65D 33/2541* (2013.01); *A44B 19/16* (2013.01); *A44B 19/24* (2013.01); *Y10T 24/158* (2015.01)

(58) Field of Classification Search

CPC B65D 33/25; B65D 33/2508; B65D 33/2591; B31B 2219/9016; B31B 2219/9019; B31B 2219/9022; A44B 19/60; A44B 19/16; A44B 19/36; Y10T 24/2582; Y10T 24/2598; Y10T 24/2513; Y10T 24/2534; Y10T 24/2511

USPC ..... 24/570, 571

See application file for complete search history.

(56) References Cited

U.S. PATENT DOCUMENTS

| | | | | |
|---|---|---|---|---|
| 2,312,045 A * | 2/1943 | Morin | A44B 19/36 24/265 A |
| 5,161,286 A | 11/1992 | Herrington, Jr. et al. | |
| 5,448,807 A | 9/1995 | Herrington, Jr. | |
| 8,407,868 B2 * | 4/2013 | Chung | A44B 13/007 114/114 |

FOREIGN PATENT DOCUMENTS

| | | |
|---|---|---|
| WO | 02/19861 | 3/2002 |

* cited by examiner

*Primary Examiner* — Jack W Lavinder

(74) *Attorney, Agent, or Firm* — McCarter & English, LLP

(57) ABSTRACT

The present disclosure relates to an end clip for a closure for a reclosable package or similar apparatus. The end clip includes any of a variety of inwardly extending engagement elements to engage portions of a closure held therebetween, particularly the flanges of the closure. The end clip is ultrasonically welded or similarly bonded to itself through the closure flanges.

4 Claims, 2 Drawing Sheets

END CLIP WITH SNAP ON AND WELD INSTALLATION

This application claims priority under 35 U.S.C. 119(e) of U.S. provisional patent application Ser. No. 61/940,995, filed on Feb. 18, 2014, the disclosure of which is hereby incorporated by reference in its entirety.

BACKGROUND OF THE DISCLOSURE

Field of the Disclosure

The present disclosure relates to an end clip for a closure for a reclosable package or similar apparatus, wherein the clip is ultrasonically welded to itself through the closure flanges.

Description of the Prior Art

End clips for polymeric closures for reclosable packages are well-known. They are intended to provide the function of preventing the slider from being pulled off of the end of the closure during ordinary use.

The prior art includes U.S. Pat. No. 5,448,807 entitled "Plastic End Clips Fused to Plastic Zipper", wherein the clip is fused with the closure profile and wherein the end clip material is required to be compatible with closure material for an acceptable bond thereby slowing the manufacturing/assembly process. The use of many types of plastic, some of which are incompatible, typically requires clips made from different plastics for each zipper. The prior art further includes U.S. Pat. No. 5,161,286 entitled "End Clamp Stops for Plastic Reclosable Fastener", wherein a post is staked and driven through the closure flange and possibly the film, entering an aperture in the opposing side of the clip where it is staked or deformed by heat, ultrasonics or another method.

OBJECTS AND SUMMARY OF THE DISCLOSURE

It is therefore an object of the present disclosure to provide for a reliable end clip for use with polymeric closures for reclosable packages while providing a method which is adaptable to high speed manufacturing and assembly.

This and other objects are attained by providing a welded end clip. The clip in the area of the closure flanges is welded to itself through the closure flanges. The clip includes one of various configurations of engagement elements, including, but not limited to, opposing teeth or triangular (or otherwise raised) energy directors. The opposing teeth may be offset with respect to each other, with a gap of a width less than that of opposing teeth, thereby resulting in a multiple shear joint configuration.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
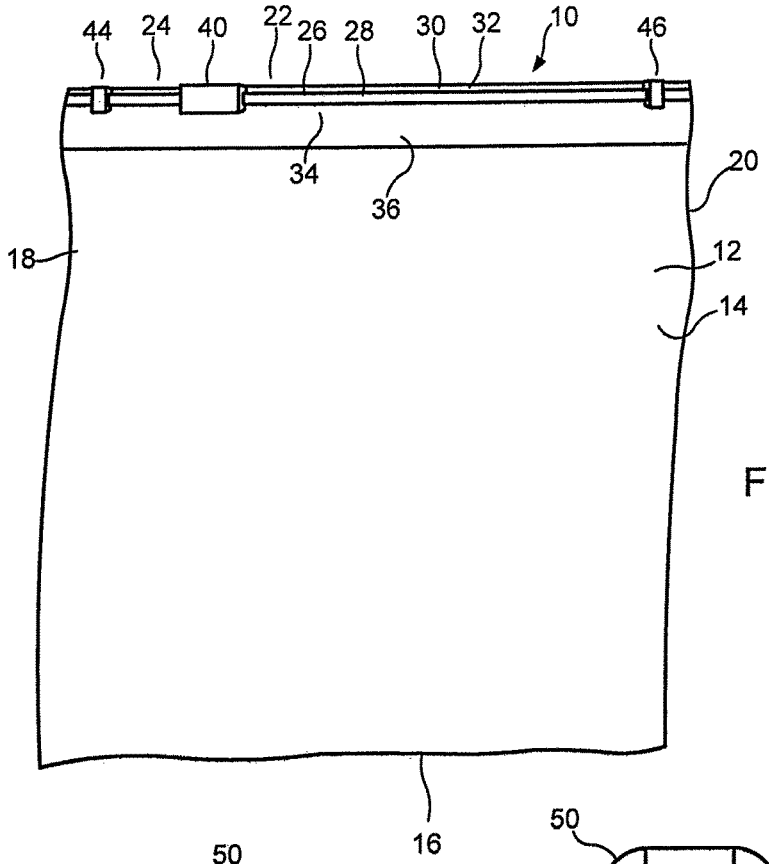
FIG. 1 is a front plan view of a reclosable plastic bag with a closure including end clips of the present disclosure.
Figure 2:
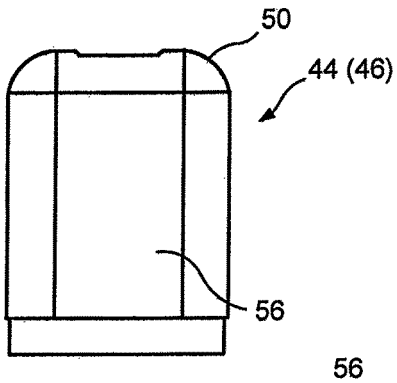
FIG. 2 is a front plan view of an end clip of the present disclosure.

Referring now to the drawings in detail, wherein like numerals indicate like elements through the several views, one sees that bag or package 10 includes front and rear polymeric package walls 12, 14 which are co-extensive and sealed to each other by a bottom seal 16 and side seals 18, 20 thereby forming mouth 22. Mouth 22 is made reclosable by polymeric closure 24. Closure 24 is illustrated as a zipper but is not limited thereto. Closure 24 includes first closure profile 26 and second closure profile 28. First closure profile 26 includes first interlocking element 30 and first flange 34 while second closure profile 28 includes second interlocking element 32 and second flange 36.

Closure 24 is operated by the slider 40 as controlled by a user. When the slider 40 is moved in an opening direction, the first and second interlocking elements 30, 32 are separated from each other, thereby separating the first and second closure profiles 26, 28 from each other. Similarly, when the slider 40 is moved in a closing direction, the first and second interlocking elements 30, 32 are interlocked with each other, thereby interlocking the first and second closure profiles 26, 28 with each other. The polymeric end clips 44, 46 are placed on ends of the closure 24 and are intended to prevent the slider 40 from being pulled off of the end of the closure 24.

Figure 3:
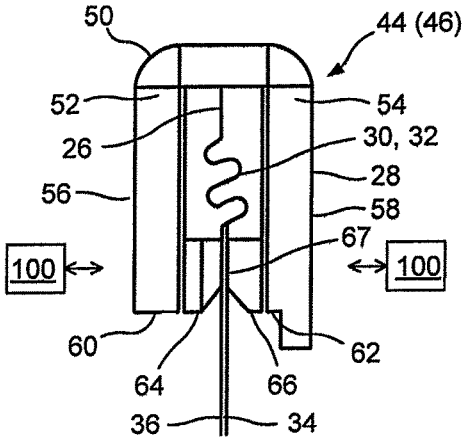
FIG. 3 is a side plan view of an end clip of the present disclosure.
Figure 4:
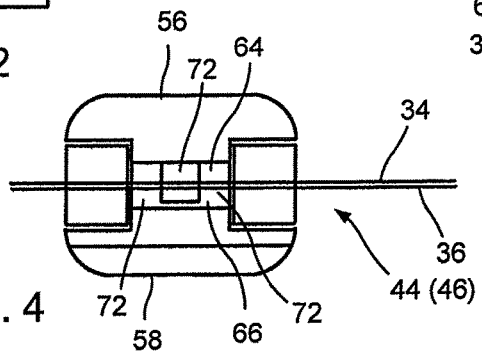
FIG. 4 is a bottom view of a first embodiment of an end clip of the present disclosure.
Figure 5:
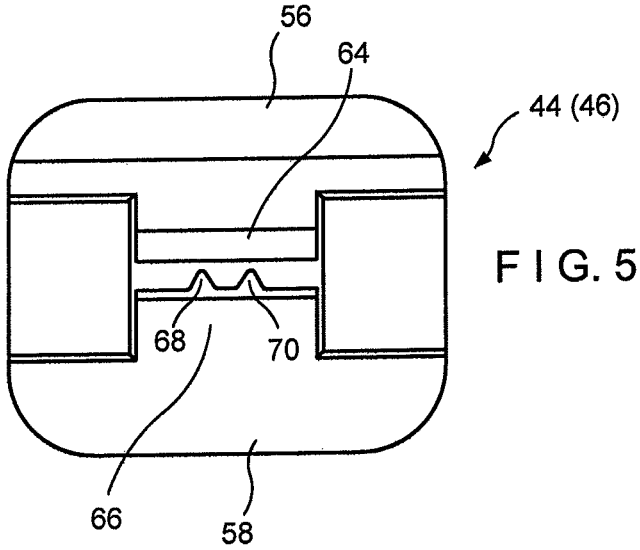
FIG. 5 is a bottom view of a second embodiment of an end clip of the present disclosure.
Figure 6:
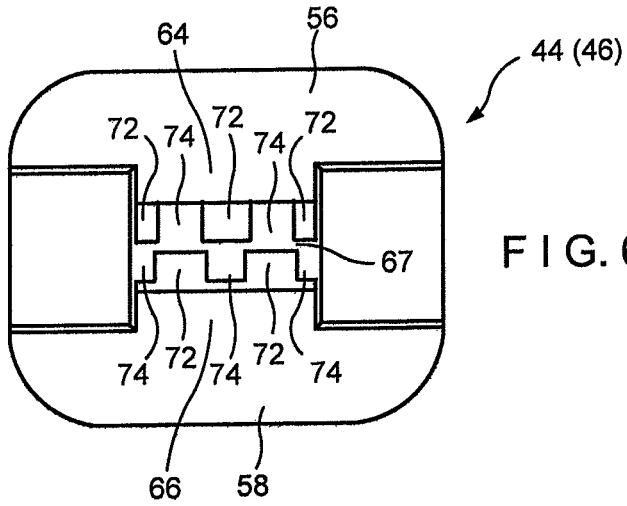
FIG. 6 is a bottom view of a third embodiment of an end clip of the present disclosure.
Figure 7:
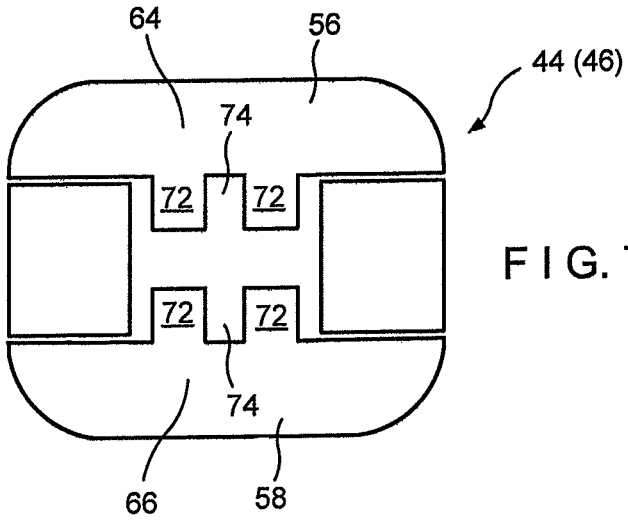
FIG. 7 is a bottom view of a fourth embodiment of an end clip of the present disclosure.

As shown in FIGS. 2-7, end clip 44 (or 46) includes an upper horizontal element 50 which joins to the first and second proximal ends 52, 54 of respective first and second opposed downwardly extending vertical sidewalls 56, 58. The first and second distal ends 60, 62 of respective first and second vertical sidewalls 56, 58 include respective first and second inwardly extending opposed engagement elements 64, 66 which are separated by a slit, a space or similar relationship 67. The end clips 44, 46 are made from polymeric material, such as, but not limited to, polyethylene, polyolefins, polyesters, nylons, polypropylenes, etc. and the resiliency of the resulting configuration will typically allow the end clips 44, 46 to be snapped onto the closure 24 prior to the welding or similar bonding process. As shown in FIG. 3, the first and second flanges 34, 36 are positioned between first and second vertical sidewalls 56, 58 and engaged in slit, space or similar arrangement 67 formed by first and second inwardly extending opposed engagement elements 64, 66. First and second inwardly extending opposed engagement elements 64, 66 pierce the first and second closure flanges 34, 36 and are then welded to each other, through the first and second closure flanges 34, 36, by ultrasonic welding. FIG. 3 further illustrates welder 100 which can be construed as a heat welder, an induction welder, an ultrasonic welder, or similar device to apply energy to the clips 44, 46. As can be seen in FIGS. 4-7, the bottom views of the first and second inwardly extending opposed engagement elements 64, 66 have various toothed or similar configurations to ensure a thorough intermixing and bonding of the ultrasonic welding process. FIG. 4 illustrates a configuration with opposing teeth 72. FIG. 5 illustrates a configuration with two energy directors 68, 70 of triangular cross section on second inwardly extending opposed engagement element 66, which are directed through the first and second closure flanges 34, 36 and into the first inwardly extending opposed engagement element 64 for ultrasonic welding. Similar energy directors may be stacked vertically as well as laterally, or anywhere on the inner face or faces of the vertical sidewalls 56, 58. FIG. 6 illustrates a multiple shear joint configuration wherein the teeth 72 of one engagement element are pointed towards the inter-tooth gaps 74 of the other engagement element. Moreover, the teeth 72 are somewhat wider than the opposing gaps 74 between teeth 72. This causes a tight intermeshing between the engaged teeth 72 and a thorough intermixing and bonding during the ultrasonic welding process. Additionally, the use of multiple spaced elements piercing the first and second closure flanges would reduce the tendency of the end clips 44, 46 to rotate, thereby making the end clips more stable. FIG. 7 illustrates a configuration wherein teeth 72 from one engagement element are directly opposed to teeth of an opposing engagement element. It should be further noted that while compatibility of the materials of the clip and the flanges is not necessary, the use of compatible materials would result in the possibility of welding the clip to the outside of the flanges without necessarily piercing the flanges.

Typically, the resulting advantages include, but are not limited to, a design and function which are simpler than that of the prior art, the use of a less complicated machine for installation of the end clips, the possibility of increased manufacturing speed, the elimination of the requirement of the compatibility of the material of the closure and the material of the clip; and the elimination of the requirement of a post being driven through the closure flange and/or package wall film.

Thus the several aforementioned objects and advantages are most effectively attained. Although preferred embodiments of the invention have been disclosed and described in detail herein, it should be understood that this invention is in no sense limited thereby.

What is claimed is:

1. A clip for providing an end stop on a closure for a reclosable package or bag, including:

an upper joining portion with a first end and a second end, a first sidewall and a second sidewall extending downwardly from the first end and second end, respectively, of the upper joining portion;

the first and second sidewall including respective first and second inwardly extending engagement elements thereby forming a slit or space therebetween for engaging a portion of a closure, the clip configured and arranged for the first and second inwardly engagement elements to be welded to each other thereby engaging a portion of a closure;

wherein teeth of the first inwardly extending engagement element oppose gaps between teeth of the second inwardly extending engagement element and wherein teeth of the second inwardly extending engagement element oppose gaps between teeth of the first inwardly extending engagement element; and wherein teeth of the first opposed inwardly extending element are wider than the gaps between teeth of the second opposed inwardly extending element.

2. The clip of claim 1 wherein the first and second inwardly extending engagement elements include teeth formed with rectangular or square cross sections.

3. The clip of claim 1 wherein teeth of the second opposed inwardly extending element are wider than the gaps between teeth of the first opposed inwardly extending element.

4. The clip of claim 1 wherein the clip is formed of polymeric material.

* * * * *